United States Patent [19]

Laemmle et al.

[11] Patent Number: 4,517,105

[45] Date of Patent: May 14, 1985

[54] METALWORKING LUBRICANT COMPOSITION CONTAINING A NOVEL SUBSTITUTED MALONIC ACID DIESTER

[75] Inventors: Joseph T. Laemmle, Delmont; John Bohaychick, New Kensington, both of Pa.

[73] Assignee: Aluminum Company of America, Pittsburgh, Pa.

[21] Appl. No.: 472,585

[22] Filed: Mar. 7, 1983

[51] Int. Cl.[3] ..... C10M 1/26

[52] U.S. Cl. ..... 252/56 R; 72/42

[58] Field of Search ..... 252/56 D, 56 R, 57; 72/42

[56] References Cited

U.S. PATENT DOCUMENTS

| | | | |
|---|---|---|---|
| 1,993,737 | 3/1935 | Graves et al. | 260/103 |
| 1,993,738 | 3/1935 | Graves et al. | 260/103 |
| 2,134,736 | 11/1938 | Reuter | 87/9 |
| 2,204,598 | 6/1940 | Humphreys et al. | 87/9 |
| 2,417,281 | 3/1947 | Wasson et al. | 252/33.4 |
| 2,820,766 | 1/1958 | Elliott et al. | 252/46.6 |
| 3,016,353 | 1/1962 | Matuszak | 252/56 D |
| 3,243,463 | 3/1966 | Doering | 252/61 |
| 3,329,617 | 7/1967 | Doering | 252/539 |
| 3,912,640 | 10/1975 | Anzenberger | 252/47.5 |
| 4,136,043 | 1/1979 | Davis | 252/47.5 |

FOREIGN PATENT DOCUMENTS

| | | |
|---|---|---|
| 2634168 | 2/1977 | Fed. Rep. of Germany . |
| 810778 | 3/1981 | U.S.S.R. . |
| 825594 | 4/1981 | U.S.S.R. . |

OTHER PUBLICATIONS

Journal of Organic Chemistry; vol. 47, pp. 4692–4702, 1982.

Chemical Abstracts; vol. 65, 4114h.

Chemical Abstracts; vol. 91:123761k.

*Primary Examiner*—Jacqueline V. Howard

*Attorney, Agent, or Firm*—Glenn E. Klepac

[57] ABSTRACT

A metalworking lubricant composition comprising a novel substituted diester of malonic acid having the general formula $$R_1R_2C(COOR_3)(COOR_4)$$

wherein $R_1$ is a $C_8$–$C_{18}$ linear alkyl group or a $C_8$–$C_{30}$ branched alkyl group or a $C_8$–$C_{30}$ alkyl aryl group; $R_2$ is H or a $C_1$–$C_{18}$ linear alkyl group or a $C_8$–$C_{30}$ branched alkyl group or a $C_8$–$C_{30}$ alkyl aryl group; and $R_3$ and $R_4$ are $C_1$–$C_4$ linear or branched alkyl groups. The substituted malonic diester may be used either in neat form or as an additive to mineral oil. The metalworking lubricant composition of the invention imparts enhanced lubricity and wear resistance to the surfaces of metals such as aluminum and aluminum alloys.

19 Claims, 1 Drawing Figure

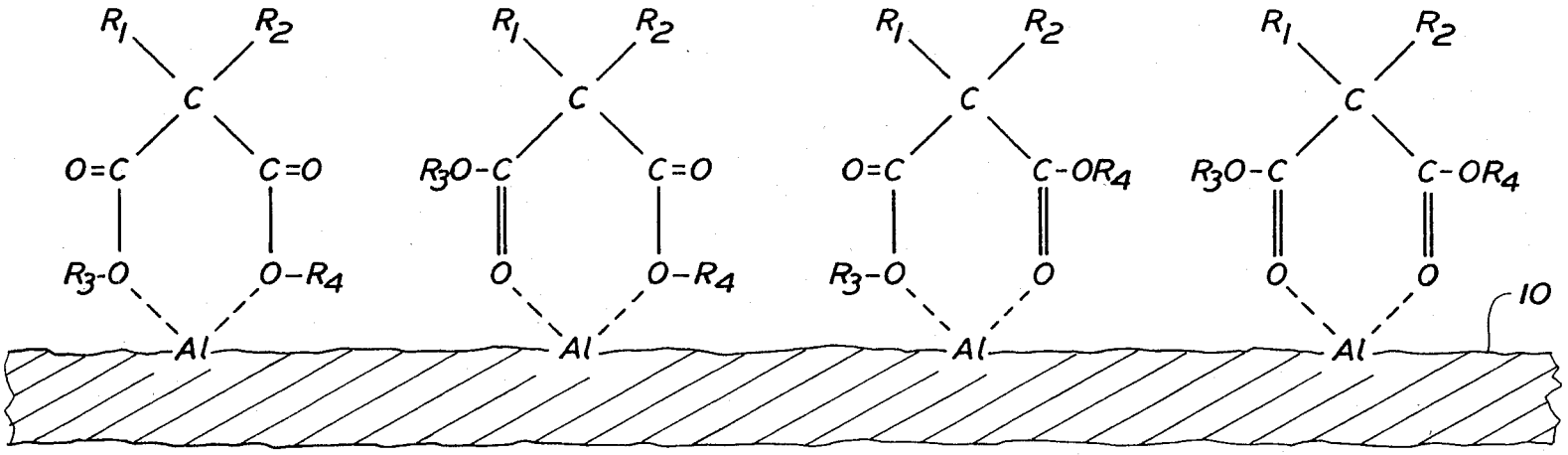
6-MEMBER RING STRUCTURES OF MALONIC DIESTERS ON AN ALUMINUM SURFACE

METALWORKING LUBRICANT COMPOSITION CONTAINING A NOVEL SUBSTITUTED MALONIC ACID DIESTER

BACKGROUND OF THE INVENTION

1. Field of the Invention

The present invention relates to lubricants that are used for imparting lubricity and wear resistance to metals such as aluminum and aluminum alloys.

2. Description of the Prior Art

Numerous metalworking lubricants are known in the prior art. However, there is a continuing demand for new lubricant compositions and for new additives to mineral oil that are capable of imparting enhanced lubricity and wear-resistance to the surfaces of metals such as aluminum and aluminum alloys.

The lubricant properties of several malonic acid diesters have been disclosed in the prior art. Some prior art patents relating to the use of malonic esters as lubricants, either alone or in combination with other synthetic ingredients are as follows: Graves et al. U.S. Pat. Nos. 1,993,737 and 1,993,738; Wasson et al. U.S. Pat. No. 2,417,281; Elliott et al. U.S. Pat. No. 2,820,766; Matuszak U.S. Pat. No. 3,016,353; and Davis U.S. Pat. No. 4,136,043. The novel substituted malonic acid diesters of the present invention include important chemical structural features not found in any of these prior art patents.

It is also known that malonic diesters different from the ones claimed herein form useful additives to petroleum oil. Some patents disclosing malonic diesters as additives in this fashion are: Reuter U.S. Pat. No. 2,134,736; Humphreys et al. U.S. Pat. No. 2,204,598; Anzenberger U.S. Pat. No. 3,912,640; and Russian Pat. Nos. 810,778 and 825,594.

It is a principal object of the present invention to provide a lubricant composition containing a novel substituted malonic acid diester.

It is a related object of the invention to provide a method for imparting lubricity and wear resistance to the surfaces of metals such as aluminum and aluminum alloys, using the lubricant composition of the invention.

Additional objects and advantages of the invention will become apparent to persons skilled in the art from the following specification.

SUMMARY OF THE INVENTION

In accordance with the present invention, there is provided a lubricant composition comprising a substituted malonic acid diester. The diester has the general formula $$R_1R_2C(COOR_3)(COOR_4)$$

In this formula, $R_1$ is a $C_8$–$C_{18}$ linear alkyl group or a $C_8$–$C_{30}$ branched alkyl group or a $C_8$–$C_{30}$ alkyl aryl group. $R_2$ is H or a $C_1$–$C_{18}$ linear alkyl group or a $C_8$–$C_{30}$ branched alkyl group or a $C_8$–$C_{30}$ alkyl aryl group. $R_3$ and $R_4$ are $C_1$–$C_4$ linear or branched alkyl groups.

The novel substituted malonic diesters described above may be applied to metal surfaces either in neat form or as additives to mineral oil. Other additives such as anti-rust agents, oxidation inhibitors, foam suppressors, dyes and the like can be included in either form of the lubricant composition. When the diester is dissolved as an additive in mineral oil, there is generally a major proportion of mineral oil and a minor proportion of the diester additive.

The lubricant composition may contain about 0.1–20 wt% of the diester additive dissolved in about 80–99.9 wt% mineral oil, and preferably comprises about 1–10 wt% of the additive dissolved in about 90–99 wt% mineral oil. A particularly preferred composition comprises about 5 wt% of the additive dissolved in about 95 wt% mineral oil.

Some particularly preferred additives are n-decyl, n-propyl diethyl malonate; di-n-dodecyl diethyl malonate and n-decyl diethyl malonate.

The substituted malonic acid diesters of the present invention provide increased resistance to wear and reduce the coefficient of friction both in neat form and when dissolved in mineral oil. These lubricant compositions are useful for metalworking operations involving metals such as aluminum and aluminum alloys.

BRIEF DESCRIPTION OF THE DRAWING

The sole FIGURE is an enlarged schematic fragmentary cross-sectional view, showing four different hypothetical structures of synthetic diesters made in accordance with the present invention bonded to an aluminum surface.

DETAILED DESCRIPTION OF A PREFERRED EMBODIMENT

It has been discovered that certain novel synthetic substituted malonic acid diesters confer surprising friction modifying and antiwear properties when applied to metal surfaces. These substituted diesters have the general structure $$R_1R_2C(COOR_3)(COOR_4)$$

In this formula, $R_1$ is a $C_8$–$C_{18}$ linear alkyl group or a $C_8$–$C_{30}$ branched alkyl group or a $C_8$–$C_{30}$ alkyl aryl group. $R_2$ is H or a $C_1$–$C_{18}$ linear alkyl group or a $C_8$–$C_{30}$ branched alkyl group or a $C_8$–$C_{30}$ alkyl aryl group. $R_3$ and $R_4$ are $C_1$–$C_4$ linear or branched alkyl groups.

Preferably, $R_1$ is a $C_8$–$C_{18}$ linear alkyl group, and $R_2$ is a $C_1$–$C_{18}$ linear alkyl group or H. Diesters in which $R_3$ and $R_4$ are $C_1$–$C_3$ linear alkyl groups are also preferred. In some particularly preferred embodiments $R_1$ may be an n-decyl group or an n-dodecyl group, and $R_2$ may be n-dodecyl or n-propyl or H. Embodiments in which $R_3$ and $R_4$ are each an ethyl group are also especially preferred.

Examples of some particularly preferred substituted malonic diesters made in accordance with the invention are n-decyl, n-propyl diethyl malonate; di-n-dodecyl diethyl malonate and n-decyl diethyl malonate.

The lubricant composition of the invention is useful in metalworking operations such as cold forming processes, machining, tapping, and drilling. The composition may also be used to decrease friction between the metal and rolls of a rolling mill and to promote good surface finish in rolled metal.

The substituted malonic diesters of the present invention are believed to form the six-member ring structures shown in the drawing when applied to surfaces of metals such as aluminum and aluminum alloys. In the drawing there is shown a surface or surface portion 10 of an article made from aluminum or an aluminum alloy. The substituted diesters are firmly bonded to the surface portion 10 because the six-member ring structures illustrated are stable at ordinary metalworking temperatures.

Lubricity and antiwear properties are enhanced because at least one of the $R_1$ and $R_2$ groups is a long chain (i.e. $C_8$ to $C_{30}$) hydrocarbon and because the $R_3$ and $R_4$ groups are both short chain (i.e. $C_1$ to $C_4$) hydrocarbons. Substituted malonic diesters in which $R_1$ and $R_2$ are less than $C_8$ hydrocarbons are expected to be less effective because shorter chains provided less protection to the metal surface 10. In addition, malonic diesters in which either $R_3$ or $R_4$ are longer chain (i.e. greater than $C_4$) hydrocarbons are expected to be less effective because of interference between $R_3$ and $R_4$ groups on adjacent diester molecules.

Similar five- and six-member ring structures have been hypothesized by Hotten for lubricant compositions containing $C_{10}$–$C_{30}$ diols and $C_{11}$–$C_{40}$ beta-ketols. See B. W. Hotten, "Bidentate Organic Oxygen Compounds as Boundary Lubricants for Aluminum", *Lubrication Engineering,* Volume 30, (1974), pages 398–403. Hotten's lubricant compositions are disclosed in his U.S. Pat. Nos. 3,649,537 and 3,649,538.

EXAMPLES

The utility of the synthetic substituted diesters as lubricating agents was investigated by comparing these materials to commonly used esters and alcohols both neat and as a 5 wt% blend in light petroleum oil. The oil had a viscosity of 4 cs at 40° C.

Testing was performed on a crossed cylinders lubricant tester. In this apparatus a steel cylinder is allowed to rotate against an aluminum cylinder at a specified load for a specified time. Friction and wear is measured and a coefficient of friction is calculated. The two aluminum alloys employed in these tests were 1100-0 and 5052-0. The results shown in Tables I and II are averages of four runs each.

TABLE I

Crossed Cylinders Test of Neat Compounds

| Compound | Chemical Structure | Alloy 1100-0 Cof | Alloy 1100-0 Wear (mm) | Alloy 5052-0 Cof | Alloy 5052-0 Wear (mm) |
|---|---|---|---|---|---|
| Methyl Laurate | $CH_3(CH_2)_{10}COOCH_3$ | 0.032 | 2.32 | 0.039 | 2.02 |
| Lauryl Alcohol | $CH_3(CH_2)_{11}OH$ | 0.021 | 3.00 | 0.025 | 2.35 |
| Oleyl Alcohol | $CH_3(CH_2)_7CH{=}CH(CH_2)_8OH$ | 0.021 | 1.89 | 0.026 | 2.37 |
| Methyl Oleate | $CH_3(CH_2)_7CH{=}CH(CH_2)_7COOCH_3$ | 0.028 | 3.34 | 0.025 | 3.06 |
| l-Octanol | $CH_3(CH_2)_7OH$ | 0.046 | 3.78 | 0.036 | 3.00 |
| n-Decyl, n-Propyl diethyl maloneate | $CH_3(CH_2)_9$ \ $C(COOC_2H_5)_2$ / $CH_3(CH_2)_2$ | 0.015 | 1.01 | 0.020 | 0.90 |
| di-n-dodecyl diethyl malonate | $[CH_3(CH_2)_{11}]_2C(COOC_2H_5)_2$ | 0.019 | 1.25 | 0.025 | 0.93 |
| n-decyl diethyl malonate | $CH_3(CH_2)_9CH(COOC_2H_5)_2$ | 0.020 | 1.22 | 0.014 | 1.00 |

TABLE II

Crossed Cylinders Tests of Additives as 5% Solutions in Light Petroleum Oil

| Additive | Alloy 1100-0 Cof | Alloy 1100-0 Wear (mm) | Alloy 5052-0 Cof | Alloy 5052-0 Wear (mm) |
|---|---|---|---|---|
| Neat Petroleum Oil | 0.045 | 1.87 | 0.055 | 1.95 |
| Methyl Laurate | 0.021 | 2.11 | 0.022 | 1.72 |
| Lauryl Alcohol | 0.026 | 2.24 | 0.024 | 2.43 |
| Oleyl Alcohol | 0.029 | 2.06 | 0.029 | 1.96 |
| Methyl Oleate | 0.025 | 1.75 | 0.019 | 1.06 |
| l-Octanol | 0.026 | 2.25 | 0.023 | 2.21 |
| n-decyl-n-propyl diethyl malonate | 0.032 | 1.49 | 0.021 | 1.46 |

TABLE II-continued

Crossed Cylinders Tests of Additives as 5% Solutions in Light Petroleum Oil

| Additive | Alloy 1100-0 Cof | Alloy 1100-0 Wear (mm) | Alloy 5052-0 Cof | Alloy 5052-0 Wear (mm) |
|---|---|---|---|---|
| di-n-dodecyl diethyl malonate | 0.032 | 1.36 | 0.015 | 1.14 |
| n-decyl diethyl malonate | 0.023 | 1.80 | 0.024 | 1.56 |

It can be seen from the data in the above Tables that the substituted malonic diesters of the present invention confer surprising antiwear and friction-reducing properties when applied to the surfaces of aluminum alloys in the 1000 and 5000 series.

The terms "mineral oil" and "petroleum oil" as used herein refer to hydrocarbon oils that are generally produced by distillation, cracking, hydrogenation or other refining process. These oils typically have boiling points in the range of about 260°–540° C. The preferred mineral oil used in the above Examples had a kinematic viscosity of 4 cs at 40° C.

The lubricant composition of the present invention may also contain conventional additives including antirust agents, oxidation inhibitors, foam suppressors and dyes.

The foregoing detailed description of the lubricant composition and method of our invention has been made with reference to a few preferred embodiments. In view of this specification, numerous changes and modifications which fall within the spirit of our invention will occur to persons skilled in the art. It is intended that all such changes and modifications be within the scope of the following claims.

What is claimed is:

1. A metalworking lubricant composition comprising (a) a minor proportion of a substituted malonic acid diester having the formula $R_1R_2C(COOR_3)(COOR_4)$, wherein $R_1$ is a $C_8$–$C_{30}$ alkyl aryl group; $R_2$ is H or a $C_1$–$C_{18}$ linear alkyl group or a $C_8$–$C_{30}$ branched alkyl group or a $C_8$–$C_{30}$ alkyl aryl group; and $R_3$ and $R_4$ are $C_1$–$C_4$ linear or branched alkyl groups and (b) a major proportion of mineral oil, said substituted malonic acid diester constituting an additive dissolved in said mineral oil.

2. The lubricant composition of claim 1 wherein $R_3$ and $R_4$ are $C_1$–$C_3$ linear alkyl groups.

3. The lubricant composition of claim 1 wherein $R_3$ and $R_4$ are each an ethyl group.

4. A metalworking lubricant composition comprising
(a) about 90–99 wt% mineral oil; and
(b) about 1–10 wt% of a substituted malonic acid diester additive having the formula $R_1R_2C(COOR_3)(COOR_4)$, wherein $R_1$ is a $C_8$–$C_{18}$ linear alkyl group or a $C_8$–$C_{30}$ branched alkyl group; $R_2$ is H or a $C_1$–$C_{18}$ linear alkyl group or a $C_8$–$C_{30}$ branched alkyl group; and $R_3$ and $R_4$ are $C_1$–$C_4$ linear or branched alkyl groups, said diester additive being dissolved in said mineral oil.

5. The lubricant composition of claim 4 wherein $R_1$ is a $C_8$–$C_{18}$ linear alkyl group and $R_2$ is a $C_1$–$C_{18}$ linear alkyl group or H.

6. The lubricant composition of claim 5 wherein $R_1$ is an n-decyl group and $R_2$ is an n-propyl group.

7. The lubricant composition of claim 5 wherein $R_1$ is an n-decyl group and $R_2$ is H.

8. The lubricant composition of claim 5 wherein $R_1$ and $R_2$ are each an n-dodecyl group.

9. The lubricant composition of claim 1 comprising about 0.1–20 wt% of said additive dissolved in about 80–99.9 wt% of said mineral oil.

10. The lubricant composition of claim 1 comprising about 1–10 wt% of said additive dissolved in about 90–99 wt% of said mineral oil.

11. The lubricant composition of claim 1 comprising about 5 wt% of said additive dissolved in about 95 wt% of said mineral oil.

12. A method for imparting lubricity and wear resistance to a metal surface, said method comprising applying to said surface a metalworking lubricant composition comprising
(a) a minor proportion of a substituted malonic acid diester having the formula $R_1R_2C(COOR_3)(COOR_4)$, wherein $R_1$ is a $C_8$–$C_{18}$ linear alkyl group or a $C_8$–$C_{30}$ branched alkyl group or a $C_8$–$C_{30}$ alkyl aryl group; $R_2$ is H or a $C_1$–$C_{18}$ linear alkyl group or a $C_8$–$C_{30}$ branched alkyl group or a $C_8$–$C_{30}$ alkyl aryl group; and $R_3$ and $R_4$ are $C_1$–$C_4$ linear or branched alkyl groups; and
(b) a major proportion of mineral oil, said substituted malonic acid diester constituting an additive dissolved in said mineral oil.

13. The method of claim 12 wherein said metal is aluminum or an aluminum alloy.

14. The method of claim 12 wherein said metal is an aluminum alloy of the 1000 series or of the 5000 series.

15. The method of claim 12 wherein said lubricant composition comprises about 1–10 wt% of said additive dissolved in about 90–99 wt% of said mineral oil.

16. The method of claim 12 wherein $R_1$ is a $C_8$–$C_{18}$ linear alkyl group and $R_2$ is a $C_1$–$C_{18}$ linear alkyl group or H.

17. The method of claim 16 wherein $R_3$ and $R_4$ are $C_1$–$C_3$ linear alkyl groups.

18. The method of claim 16 wherein $R_3$ and $R_4$ are each an ethyl group.

19. The method of claim 16 wherein $R_1$ and $R_2$ are selected from the group consisting of an n-dodecyl group, an n-decyl group, an n-propyl group and H.

* * * * *